US008505737B2

(12) United States Patent
Malmberg

(10) Patent No.: US 8,505,737 B2
(45) Date of Patent: Aug. 13, 2013

(54) SUPPORT CARRIER FOR A VIBRATING SCREEN DEVICE

(75) Inventor: Mats Malmberg, Rydsgård (SE)

(73) Assignee: Sandvik Intellectual Property AB, Sandviken (SE)

( * ) Notice: Subject to any disclaimer, the term of this patent is extended or adjusted under 35 U.S.C. 154(b) by 248 days.

(21) Appl. No.: 13/045,795

(22) Filed: Mar. 11, 2011

(65) Prior Publication Data

US 2011/0220556 A1 Sep. 15, 2011

(30) Foreign Application Priority Data

Mar. 15, 2010 (SE) ..... 1050232

(51) Int. Cl.
*B07B 1/46* (2006.01)

(52) U.S. Cl.
USPC ..... 209/405; 209/409; 209/412

(58) Field of Classification Search
USPC ..... 209/319, 405, 408, 409, 412
See application file for complete search history.

(56) References Cited

U.S. PATENT DOCUMENTS

| | | | | |
|---|---|---|---|---|
| 3,390,771 | A * | 7/1968 | Wehner | 209/365.1 |
| 4,661,245 | A * | 4/1987 | Rutherford et al. | 209/399 |
| 4,885,040 | A | 12/1989 | Wolff | |
| 6,253,926 | B1 | 7/2001 | Woodgate | |
| 6,715,613 | B2 * | 4/2004 | Eeles et al. | 209/405 |
| 7,296,685 | B2 * | 11/2007 | Malmberg | 209/405 |
| 7,841,476 | B2 * | 11/2010 | Johnson et al. | 209/405 |
| 8,286,799 | B2 * | 10/2012 | Malmberg | 209/405 |
| 2003/0042178 | A1 * | 3/2003 | Robertson et al. | 209/405 |
| 2005/0224397 | A1 * | 10/2005 | Malmberg | 209/397 |
| 2008/0257791 | A1 * | 10/2008 | Malmberg | 209/405 |
| 2009/0050539 | A1 * | 2/2009 | Gronvall et al. | 209/391 |
| 2009/0166268 | A1 * | 7/2009 | Malmberg | 209/405 |
| 2009/0301945 | A1 * | 12/2009 | Trench et al. | 209/405 |

FOREIGN PATENT DOCUMENTS

| | | | |
|---|---|---|---|
| AU | 2004200133 | A1 | 2/2004 |
| WO | WO-2005092523 | A1 | 10/2005 |

OTHER PUBLICATIONS

International-type search report from related Swedish application No. 1050232-6, dated Sep. 9, 2010 (in Swedish and English language), 10 pages.

* cited by examiner

*Primary Examiner* — Joseph C Rodriguez
(74) *Attorney, Agent, or Firm* — Morgan, Lewis & Bockius LLP

(57) ABSTRACT

A vibrating screen device includes a support structure, which supports apertured screening elements. The support structure includes a plurality of support carriers, each having a straight portion and a spacer part fixed to at least one end of the straight portion. The spacer part of each support carrier engages a spacer part of an adjacent support carrier to space the straight portions apart by a predetermined distance.

9 Claims, 4 Drawing Sheets

SUPPORT CARRIER FOR A VIBRATING SCREEN DEVICE

RELATED APPLICATION DATA

This application claims priority under 35 U.S.C. §119 and/or §365 to Swedish patent application No. 1050232-6, filed Mar. 15, 2010, the entire contents of which are incorporated herein by reference.

TECHNICAL FIELD

The present disclosure concerns a support carrier of a support structure for supporting screening media in a vibrating screen device invention concerns a support carrier of a support structure for supporting screening media in a vibrating screen device.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

In vibrating screen devices used for fractionation of for example crushed stones and gravel into fractions of stones with different sizes, screening media are used having screening holes for allowing stones smaller than the screening holes to pass through the holes.

Vibrating screen devices are known having an adapter system or a supporting structure to be able to use different types of screening media. The screening media normally have the form of a wire mesh, polymer mats, panels or modular screening elements. The supporting structure has the form of a number of elements placed in a grid supporting the screening media.

In one previously known embodiment, the support structure is formed of support carriers and transversal carriers. The support carriers are placed in line with each other in several parallel lines of support carriers. Also the transversal carriers are placed in line with each other in several parallel lines of transversal carriers. The support carriers are placed on top of the transversal carriers and perpendicular to the transversal carriers. Loose spacer elements are placed on top of the transversal carriers. The spacer elements are to keep a proper distance between the lines of support carriers. Even though they normally function well, in some cases the spacer elements have not been able to hold a proper distance between the support carriers.

It would be desirable to enable the handling of the component parts of the support structure of the vibrating screen device to be facilitated, regarding mounting, storing and transportation of such parts.

It would also be desirable to guarantee that the parts of the support structure are placed at proper positions in relation to each other.

It would further be desirable to be able to modify the set-up of the vibrating screen device without having to make any major rebuilding thereof. The set-up of the vibrating screen device may need to be modified depending on the type of material to be fractionized, the sizes of the fractions etc. Such modifications include changing the size or type of the screening media used.

SUMMARY

Disclosed is a support carrier of a supporting structure of a vibrating screen device, wherein the support carrier includes at least one straight portion and at least one spacer part extending transversely from an end of the straight portion. The spacer part is fixed to the at least one straight portion.

By fixing the spacer elements to the straight portion of the support carriers, fewer parts need to be handled. Furthermore, the spacing between adjacent support carriers is held more exactly. Preferably, each support carrier has at least one straight portion and at least one spacer part, with the at least one straight portion of each support carrier being fixed to the at least one spacer part. The straight portion and spacer parts of each support carrier are placed perpendicular to each other.

Objects and advantages of the disclosed embodiments will be obvious to a person skilled in the art when reading the detailed description below.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which:

FIG. 1 is a perspective view of a vibrating screen device.

FIGS. 9-14 depict further examples of support carriers having different upper configurations, wherein

DETAILED DESCRIPTION

As used in this description the expressions "upper", "lower" and similar expressions are in view of the drawings referred to and with the normal orientation of a vibrating screen.

Figure 1:
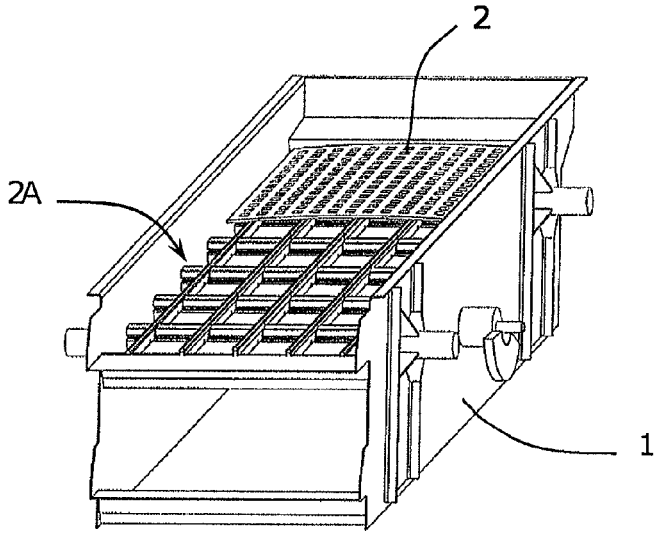
FIG. 1 is

In FIG. 1 one example of a vibrating screen device 1 is shown. It has a screening deck receiving materials to be screened, such as crushed stones, gravel etc. The screening deck is furnished with screening media, formed of a number of modular screening elements 2, e.g., a wire mesh, polymer mats or panels. The screening media are received on a support structure 2A.

The support structure 2A is formed of support carriers 3 and transversal carriers 4. The transversal carriers 4 are placed transversal to the direction of motion D of the material to be screened, and the transversal carriers 4 are placed parallel with each other. The transversal carriers 4 are fastened by bolting, welding or other suitable fastening means to cross members (not shown) of the vibrating screen deck. The support carriers 3 are placed parallel to each other on top of the transversal carriers 4 and are oriented perpendicular to the transversal carriers 4.

Figure 2:
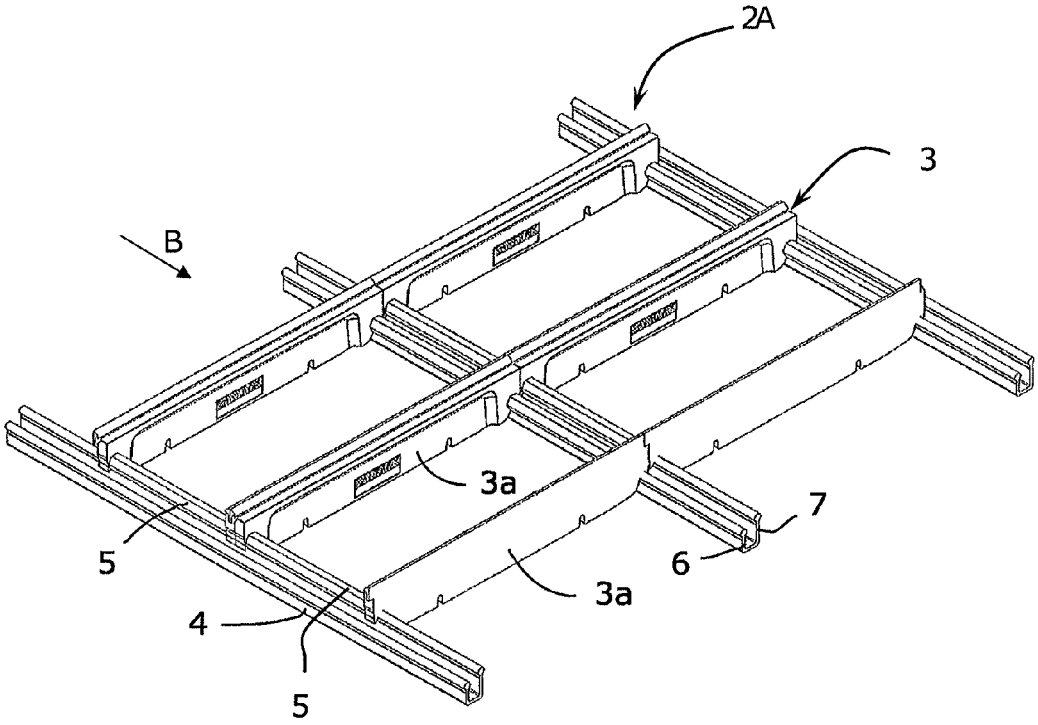
FIG. 2 is a perspective view of one example of a supporting structure for supporting screening media of the vibrating screen device.
Figure 3:
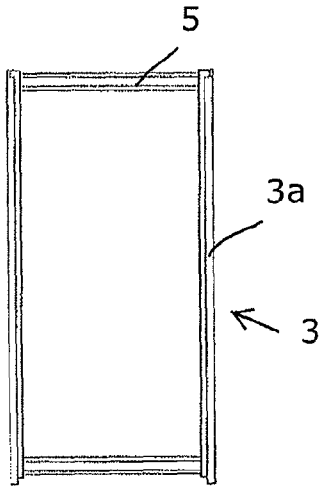
FIG. 3 is a plan view of a first example of a support carrier of the supporting structure having fixed spacer parts.

In the example shown in FIGS. 2 and 3, the support carrier 3 is formed of two straight portions 3*a* and two spacer parts 5, together forming a rectangular frame, as viewed from above. The two straight portions 3*a* are placed on opposite sides of the frame and the two spacer parts 5 are also placed on opposite sides of the frame. The two straight portions 3*a* and two spacer parts 5 are fixed together to form a one-piece frame. In use, the frame is placed on the transversal carriers 4 with two straight portions 3*a* of adjacent support carriers 3 abutting each other in the direction B, and with two spacer parts 5 of adjacent support carriers 3 placed adjacent each other in a direction perpendicular to the direction B. Each straight portion 3*a* of the frame has half the normal thickness of the straight portion of the supporting structure. Thus, when two straight portions 3*a* of two adjacent frames are placed abutting each other they will together have the normal thickness.

The spacer parts 5 are placed on stanchions 6, 7 of the transversal carriers 4, whereby the spacer parts 5 have a groove on the lower side adapted to the form of the stanchions 6, 7. In the example of FIGS. 2 and 3, the stanchions 6, 7 have different heights. Therefore, the spacer parts 5 of each frame are positioned on different heights, to be adapted to the heights of the stanchions 6, 7. Alternatively, in other embodiments the stanchions could be of the same height, whereby also the spacer parts would be disposed at equal heights in the frame.

Figure 4:
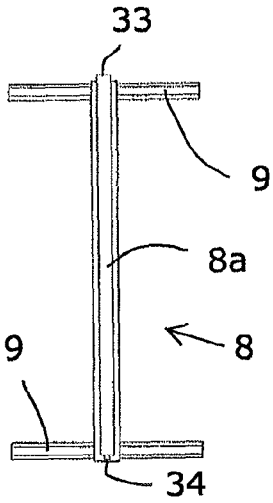
FIG. 4 is a plan view of a second example of a support carrier having fixed spacer parts.
Figure 5:
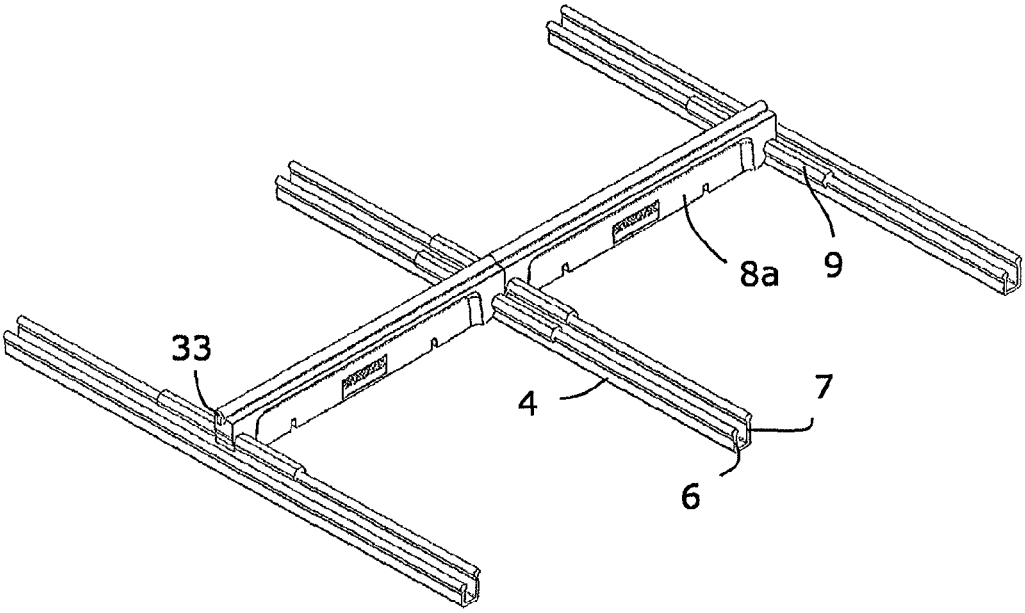
FIG. 5 is perspective view of a plurality of support carriers according to FIG. 4, forming a supporting structure.

In FIGS. 4 and 5 a further example of a support carrier 8, according to the present invention is shown. The support carrier 8 has a central straight portion 8*a* and one spacer part 9 at each end of the straight portion 8*a*. The spacer parts 9 are placed perpendicular to the straight portion 8*a* and extend equal distances on either side of the straight portion 8*a*. Thus, the support carrier 8 will have the shape of an I-beam, as seen from above. The support carrier 8 is made in one piece, i.e., the spacer parts 9 are fixed to the straight portion 8*a* of the support carrier 8.

The support carriers 8 are placed on stanchions 6, 7 of the transversal carriers 4. In the examples of FIGS. 2 and 5, each of the transversal carriers 4 has two stanchions 6, 7 placed parallel with each other and at a distance from each other. The two stanchions 6, 7 shown have different heights, but in other, alternative embodiments the stanchions could be of the same height. Each support carrier 8 has one of its spacer parts 9 placed on the stanchion 6 of a transversal carrier 4, and its other spacer part 9 placed on the stanchion 7 of another transversal carrier 4. The spacer parts 9 each has a groove on the lower side. The form of the groove is adapted to the form of the upper part of the respective stanchion 6, 7.

It will thus be appreciated that each transversal carrier 4 receives spacer parts 9 of two mutually aligned support carriers 8, with one spacer part 9 disposed on each stanchion 6, 7. Thus, two support carriers 8 are placed abutting each other on the transversal carriers 4.

In the embodiments shown in FIGS. 2 to 5, the upper central part, or top, of each straight portion has an extension 33 (see FIG. 4) forming a projection extending a short distance from one end of the straight portion and has a complementary groove 34 at the other end. The projection 33 has a thickness adapted to the width of the groove 34. Thus, when two support carriers 8 are placed abutting each other in the direction B, the projection 33 of one support carrier 8 is received in the complementary groove 34 of the adjacent support carrier 8. In use, two adjacent support carriers 8 are placed with the ends of the spacer parts 9 abutting each other. Thus, the distance between the support carriers 8 is dictated by the distance by which respective spacer part 9 extends from the straight portion 8*a* of its respective support carrier 8.

Figure 7:
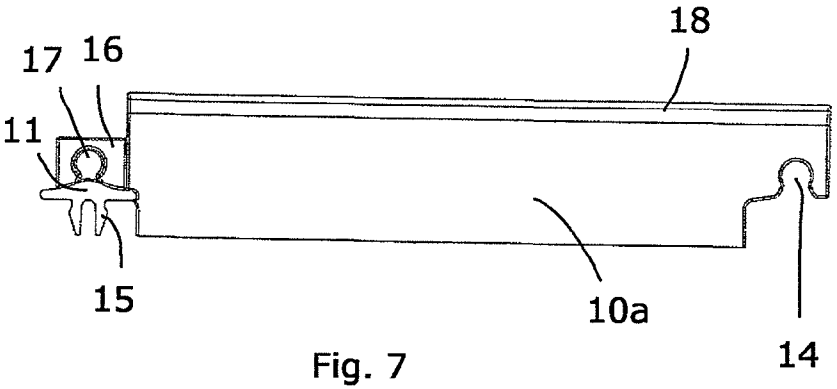
FIG. 7 is a side elevational view of the support carrier of FIG. 6.
Figure 8:
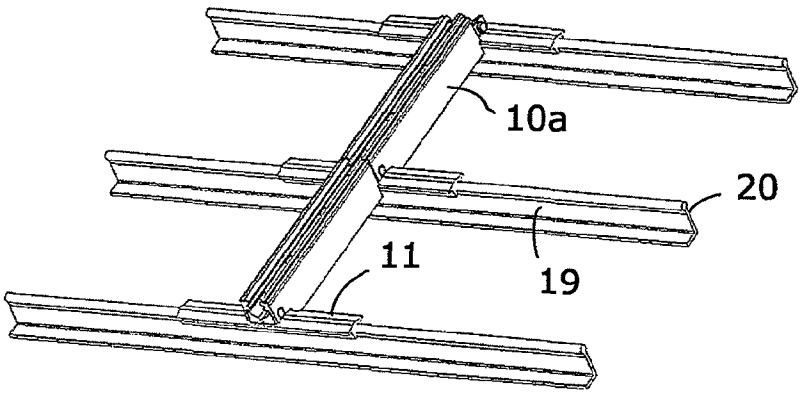
FIG. 8 is a perspective view of support carriers of FIGS. 6 and 7, arranged to form a supporting structure.
Figure 6:
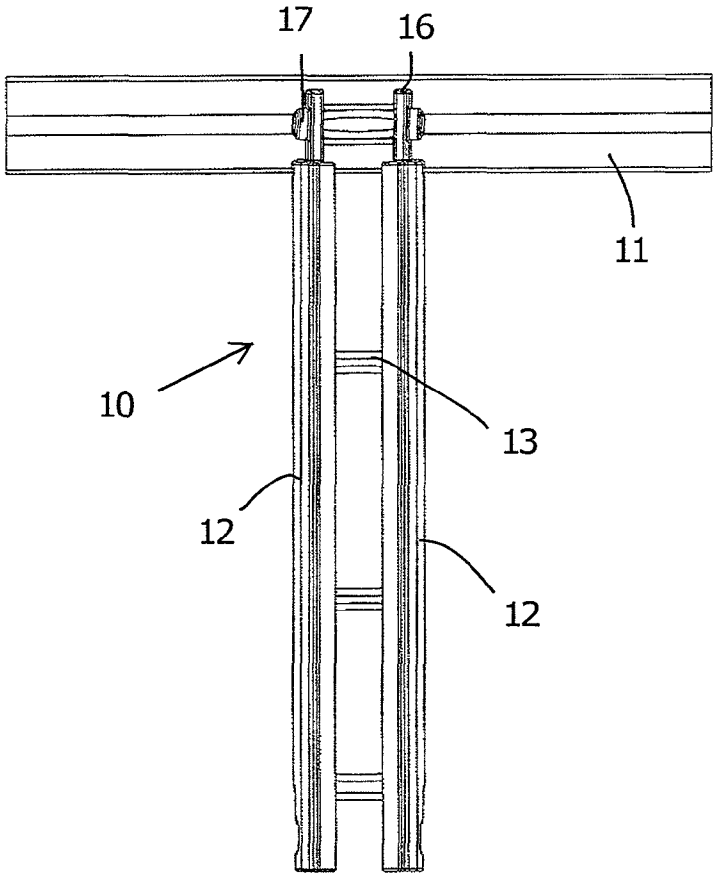
FIG. 6 is a plan view of a third example of a support carrier and fixed spacer part.

The support carrier 10 of FIGS. 6-8 has an elongated form, and in the shown embodiment it has a straight portion 10*a* formed of two parallel plates 12 placed at a short distance from each other. The two parallel plates 12 are fixed to each other by means of a number of attachment members 13. Each support carrier 10 has a spacer part 11 at one end which is oriented perpendicular to the plates 12 of the support carrier 10 and which extends on both sides of the support carrier 10. The spacer part 11 is made in one piece with the rest of the support carrier 10. The spacer part 11 extends the same distance from the straight portion 10*a* of the support carrier 10 at both sides. Thus, the support carrier 10 with the spacer part 11 has the shape of a "T", as seen from above.

At the free end of the support carrier 10, i.e. the end opposite the end with the integrated spacer part 11, there is a groove 14 open from below. The groove 14 is used when attaching the support carriers 10 to each other in forming the support structure.

The spacer parts 11 have two rails 15 extending downwards, between which rails 15 a groove is formed. The rails 15 are used in attaching the spacer parts 11 to stanchions 20 of transversal carriers 19. The spacer parts 11 assist in keeping the straight elements 10*a* of the support carriers 10 at proper mutual distance from each other.

In the area of connection between the support carrier 10 and the spacer part 11, a lug 16 extends from each plate 12. Thus, there are two lugs 16. The lugs 16 have the same direction as the plates 12 of each support carrier 10, and the lugs 16 extend perpendicular to the extension of the spacer part 11. The lugs 16 are disposed on top of the spacer part 11. A pin 17 is placed on each lug 16, which pins extend in opposite directions by equal distances from the respective lugs 16. The pins 17 are received in the grooves 14 of an adjacent support carrier 10 when the support carriers are installed for use.

In use, the support carriers 10 are placed in line abutting each other and with the spacer element 11 of each support carrier 10 placed on the stanchion of a transversal carrier 19.

A rail 18 is disposed on top of each plate 12 for attachment to screening media. Alternatively, the plates 12 could have groves on the inside, or other means, used to fix screening media to the support carriers 10. The exact form of the rails 18 (or alternative grooves) is adapted to the form of the screening media to be received.

As noted above, and as indicated in FIGS. 9*a*-9*f*, the top of each straight portion of the support carriers may have different forms adapted to the design and make of the screening media to be received on top of the support carriers.

Figures 9B, 10B, 11B, 12B, 13B, 14B:
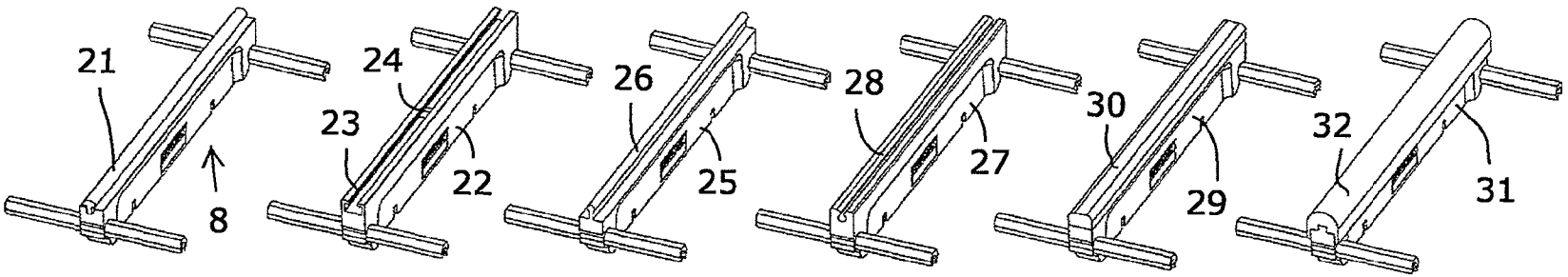
FIGS. 9*b*, 10*b*, 11*b*, 12*b*, 13*b* and 14*b* are perspective views.
Figures 9A, 10A, 11A, 12A, 13A, 14A:
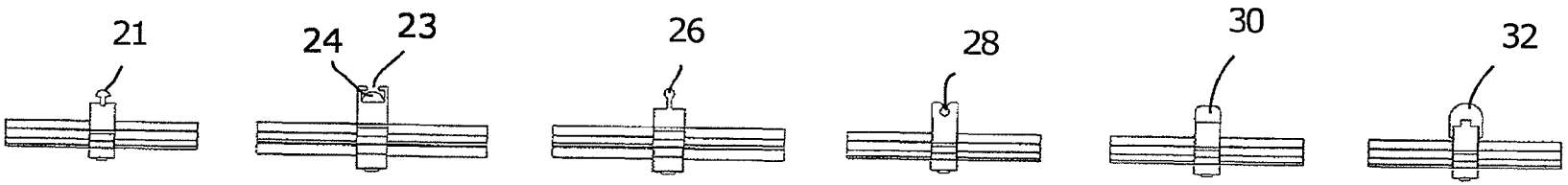
FIGS. 9*a*, 10*a*, 11*a*, 12*a*, 13*a* and 14*a* are end views.

The support carrier 8 of FIG. 9*a* corresponds with the support carrier of FIGS. 4 and 5 and has a rail 21 at the top. Also the support carriers 25, 29, 31 of FIGS. 9*c*, 9*e* and 9*f*, respectively, have a kind of rail 26, 30, 32 each. The support carrier 22 of FIG. 9*b* has a groove 23 at the top. In the middle of the groove 21, as seen in the longitudinal direction of the straight portion of the support carrier 22, there is a raised part 23. Also the support carrier 27 of FIG. 9*d* has a groove 28 at the top of the straight portion of the support carrier 27.

A person skilled in the art will realize that the features of the different embodiments described may be combined in many different ways, and that additions, deletions, modifications and substitutions not specifically described may be made without departing from the spirit and scope of the invention defined in the appended claims.

What is claimed is:

1. Support carrier of a supporting structure of a vibrating screen device, wherein the support carrier includes:

at least one straight portion; and at least one spacer part extending transversely from an end of the straight portion, wherein the spacer part is fixed to the at least one straight portion, wherein the straight portion is formed of two parallel plates fixed to each other by a plurality of attachment elements placed between lower edges of the two plates, wherein each plate has a lug extending from one end thereof and disposed above the respective spacer part, each lug having a in extending therefrom in a direction opposite the in of the other plate, and wherein each plate has a groove disposed at the opposite end thereof, the groove opening downwards and configured for receiving one of the pins of an adjacent support carrier.

2. The support carrier as claimed in claim 1, wherein the at least one straight portion and the spacer part each have a main extension and the main extensions are perpendicular to each other.

3. The support carrier as claimed in claim 1, wherein the support carrier comprises two said straight portions and two said spacer parts arranged to form a rectangular frame, and wherein the two straight portions are parallel to one another on opposite sides of the frame, and the spacer parts are oriented parallel to one another on opposite sides of the frame.

4. The support carrier as claimed in claim 1, wherein the spacer part extends from respective sides of the straight portion by equal distances.

5. The support carrier as claimed in claim 1, wherein the spacer part extends from respective sides of the straight portion by equal distances.

6. The support carrier as claimed in claim 1, wherein the upper edge of each straight portion includes a rail or a groove configured to connect to screening media.

7. Support of a supporting structure of a vibrating screen device, wherein the support carrier includes:

at least one straight portion; and at least one spacer part extending transversely from an end of the straight portion, wherein the spacer part is fixed to the at least one straight portion, wherein the support carrier has only one straight portion and a spacer part disposed at only one end of the straight portion, wherein the straight portion is formed of two parallel plates fixed to each other by a plurality of attachment elements placed between lower edges of the two plates, wherein each plate has a lug extending from one end thereof and disposed above the respective spacer part, each lug having a pin extending therefrom in a direction opposite the pin of the other plate, and wherein each plate has a groove disposed at the opposite end thereof, the groove opening downwards and configured for receiving one of the pins of an adjacent support carrier.

8. A vibrating screen device comprising a support structure for supporting apertured screening elements, the support structure comprising:

a plurality of support carriers, each support carrier comprising at least straight portion and at least one spacer part fixed to at least one end of the straight portion and extending transversely from an end of the straight portion, wherein the straight portion is formed of two parallel plates fixed to each other by a plurality of attachment elements placed between lower edges of the two plates, wherein each plate has a lug extending from one end thereof and disposed above the respective spacer part, each lug having a pin extending therefrom in a direction opposite the pin of the other plate, wherein each plate has a groove disposed at the opposite end thereof, the groove opening downwards and configured for receiving one of the pins of an adjacent support carrier, and wherein the spacer part of each support carrier engages a spacer part of an adjacent support carrier to space the support apart by a predetermined distance.

9. The vibrating screen device according to claim 8, wherein the vibrating screen device further includes transverse carriers comprised of stanchions on which the support carriers are mounted.

* * * * *